United States Patent [19]

van der Laan et al.

[11] Patent Number: 4,516,860

[45] Date of Patent: May 14, 1985

[54] MIXER FOR DRILL CUTTINGS AND DRILLING MUD ON A DRILLING LOCATION

[75] Inventors: Jan G. J. van der Laan, Warnsveld; Willem Entrop, Gemeente Noordwijkerhout, both of Netherlands

[73] Assignee: Hosokawa-Nauta B.V., Netherlands

[21] Appl. No.: 491,453

[22] Filed: May 4, 1983

[30] Foreign Application Priority Data

Jun. 5, 1982 [NL] Netherlands ..... 8201868

[51] Int. Cl.[3] ..... B01F 7/08

[52] U.S. Cl. ..... 366/287

[58] Field of Search ..... 366/287, 288, 279, 281, 366/282, 292, 297, 318, 321

[56] References Cited

U.S. PATENT DOCUMENTS

| | | | |
|---|---|---|---|
| 3,301,323 | 1/1967 | Parsons . | |
| 3,450,390 | 6/1969 | Nauta | 366/292 |
| 3,533,604 | 10/1970 | Sabelis | 366/287 |
| 3,602,486 | 8/1971 | Nauta | 366/292 |
| 3,612,492 | 10/1971 | Nauta | 366/292 |

FOREIGN PATENT DOCUMENTS

| | | |
|---|---|---|
| 2007309 | 4/1981 | Fed. Rep. of Germany . |
| 6616525 | 5/1968 | Netherlands . |

*Primary Examiner*—Robert W. Jenkins

*Attorney, Agent, or Firm*—Andrus, Sceales, Starke & Sawall

[57] ABSTRACT

A device for mixing of liquids and particulate solids, such as for instance a drilling liquid and drill cuttings on a drilling location. This drilling location can be a deep well drilled for gas and/or oil by means of a drilling tower on-or off-shore. The invention provides an elongated, rectangular open mixing tank (2,3,4,5) on which a series of replacable agitating units (6*a*, 6*b*) having their axes (22*a*, 22*b*) in one vertical plane is mounted. The agitating devices (6*a*, 6*b*) each comprise a unit having a rotatably driven head (21*a*, 21*b*) carrying two support arms (23*a*, 23*b*; 24*a*, 24*b*) of unequal length which each support a mixing screw (27*a*, 27*b*, 28*a*, 28*b*) projecting into the mixture of liquids and particulate solids. This arrangement provides a thorough mixture of the drilling liquid, having a high viscosity and high specific gravity, with the drill cuttings frequently comprising heavy clay and/or rock particles.

8 Claims, 4 Drawing Figures

Figure 1:
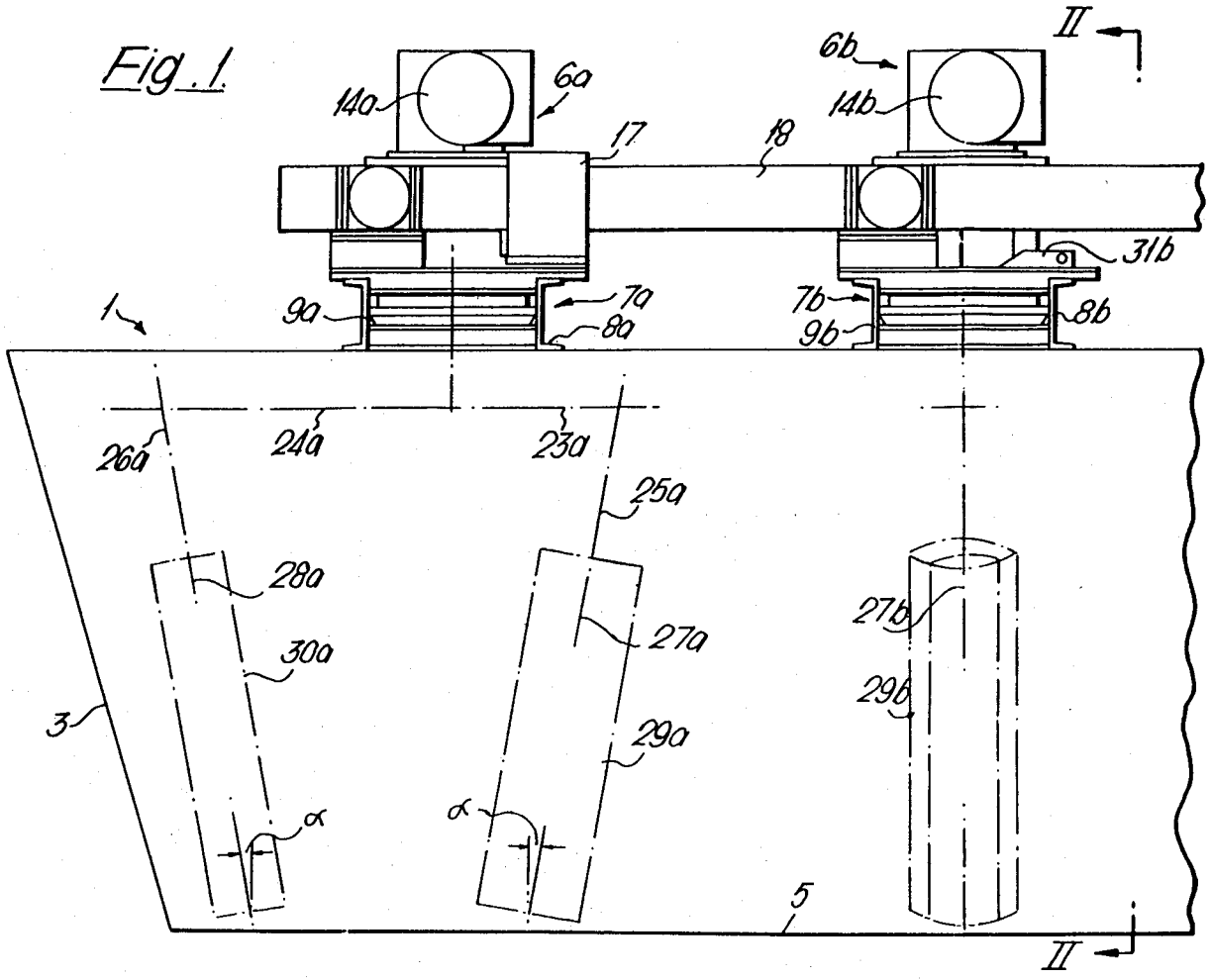

Fig. 2.a
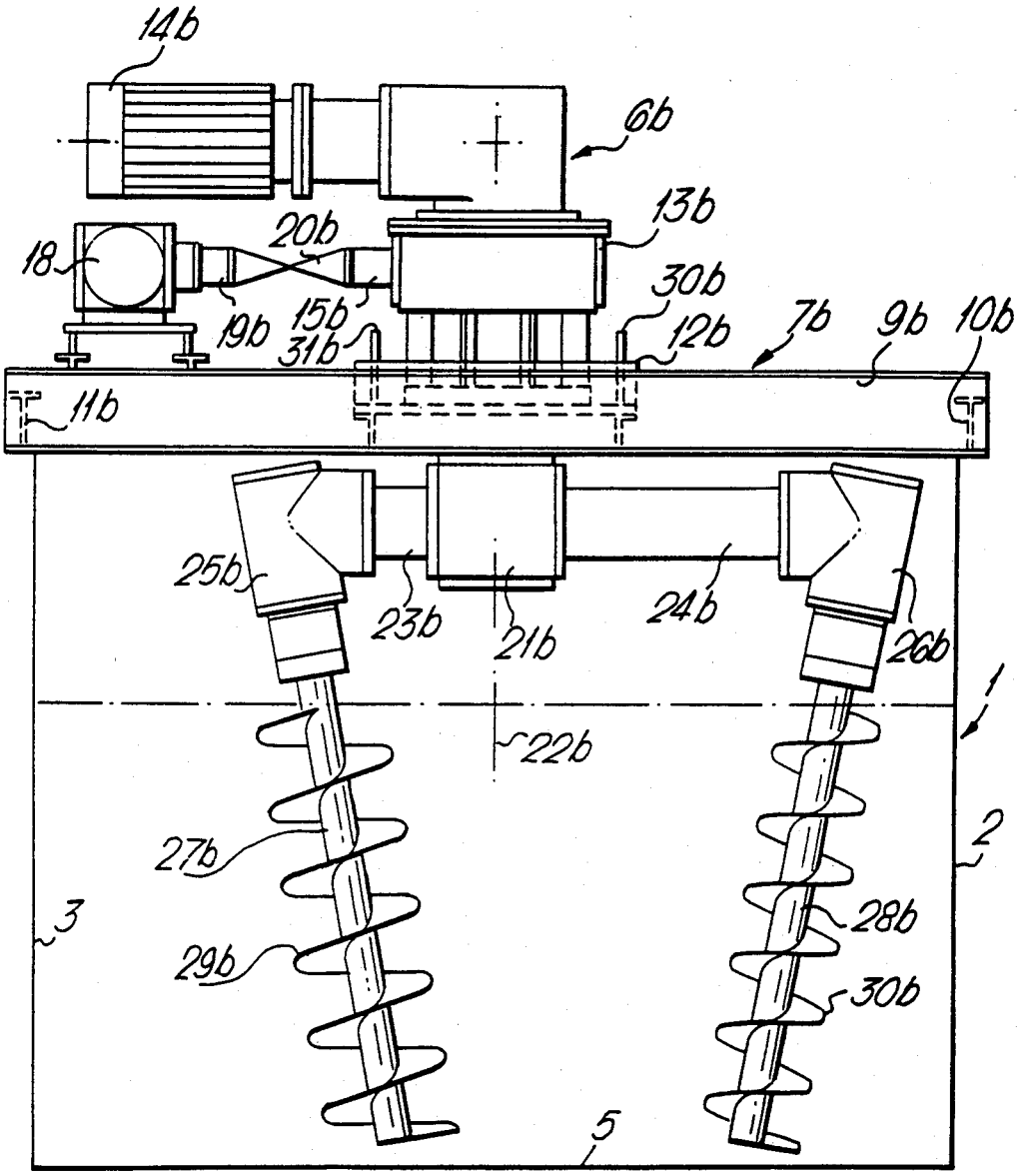

Fig. 2.b
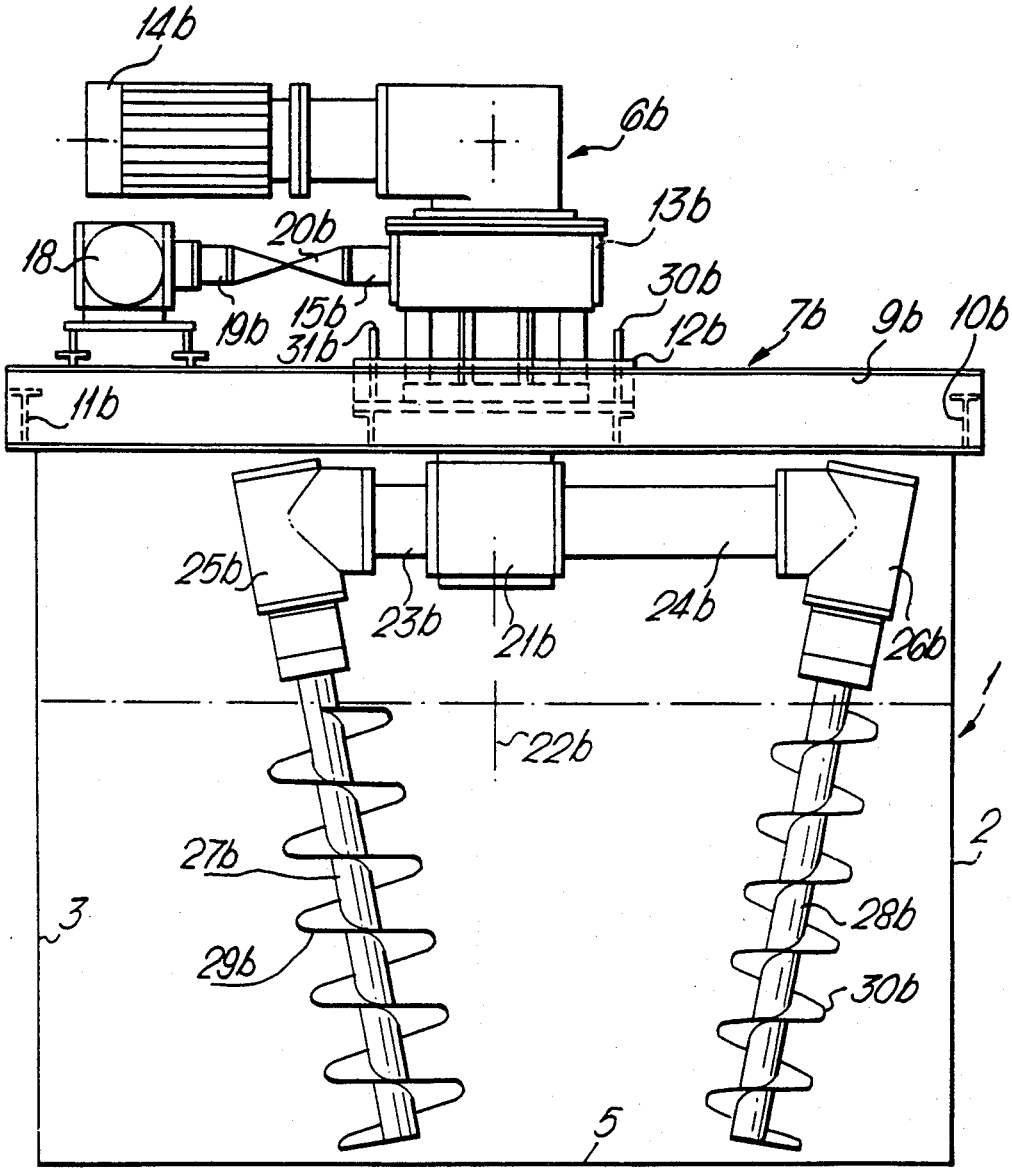

MIXER FOR DRILL CUTTINGS AND DRILLING MUD ON A DRILLING LOCATION

The invention relates to a device for mixing liquids and particulate solids, such as for instance drilling mud and drill cuttings, which device is provided with a mixing vessel in which a plurality of agitating devices extend.

On drilling locations, such as for instance deep drillings for gas and/or oil, which are made by means of a drilling tower which is placed on land directly on the soil and at sea or "off-shore" for instance on a drilling platform or island so called drilling mud is used, for cooling the drill bit, the plastering of the drilling hole and the removal therefrom of the drill cuttings. This drilling mud should in the first place have a high specific weight, by means of which the column of drilling mud can control the liquids and/or gases in the layers of the formation on the corresponding depth without danger of blow outs. In the second place the viscosity of the drilling mud should be higher than that of water, whereby the drill cuttings can be entrained easier by the rising flow of drilling mud than would be the case when using water. As a result of these requirements this drilling mud most frequently contains a mixture of clay and other chemicals, such as bentonite, soda ash, quebracho, bariumsulfate of ferrioxyde and in some cases mica. Outside the drilling hole one frequently tries to separate the drill cuttings from the drilling liquid, after which the drilling liquid is again brought on specification and again pumped into the drilling hole. The drill cuttings that contain a number of the above mentioned chemicals are dumped.

As the regulations for the protection of the environment against chemical pollution are ever becoming stricter it is in many cases no longer legally permissible to dump the chemically polluted drill cuttings without treatment on a refuse dump or, as is sometimes usual on a drilling at sea, put it overboard, as the sea could get polluted in this way. It is possible however to concentrate the drill cuttings together with the drilling liquid, press it to bricks, which bricks than may be put overboard, as they do not cause pollution of the sea.

The need therefore exists for a mixing device with which the drilling mud and the drill cuttings can be kept in a thorough mixture. It is not possible to use any propellor stirring devices for this mixing device, as they are not able to keep the drill mud having a high specific weight and a high viscosity in mixture with the frequently also heavy drill cuttings.

By the device according to the invention, which is provided with a mixing vessel in which a number of agitating devices extend, this abovementioned need is satisfied, in that a series of agitating devices project from the upper side into the mixing vessel, in which this series of agitating devices each comprise one or more support arms rotating around a substantially vertical axis, which support arms each carry at their other end a downwardly extending mixing screw, which mixing screw can be rotatably driven around its own longitudinal axis.

By the application of the invention is possible to keep the drilling mud the drill cuttings in good mixture without any problems, and without the high viscosity and the high specific weight of the drilling mud, and the high weight of the for instance heavy clay and/or rock particles of the drill cuttings could cause a separation of the drill cuttings and the drilling mud.

It is remarked, that the mixing screws applied in the mixing device according to the invention are however per se known, such as for instance from the U.S. Pat. No. 3,612,492.

According to a preferential embodiment of the invention the agitating devices of these series each comprise two support arms of unequal length, which each carry rotatable mixing screws of equal length.

The invention will now further be elucidated referring to the accompanying drawing of an embodiment.

FIG. 1 is a broken off side view of a device according to the invention.

FIG. 2*a* is an end view of in cross section taken over the line II—II in FIG. 1.

FIG. 2*b* is an end view taken over the line II—II in FIG. 1 showing a modification of the device according to the invention.

Figure 3:
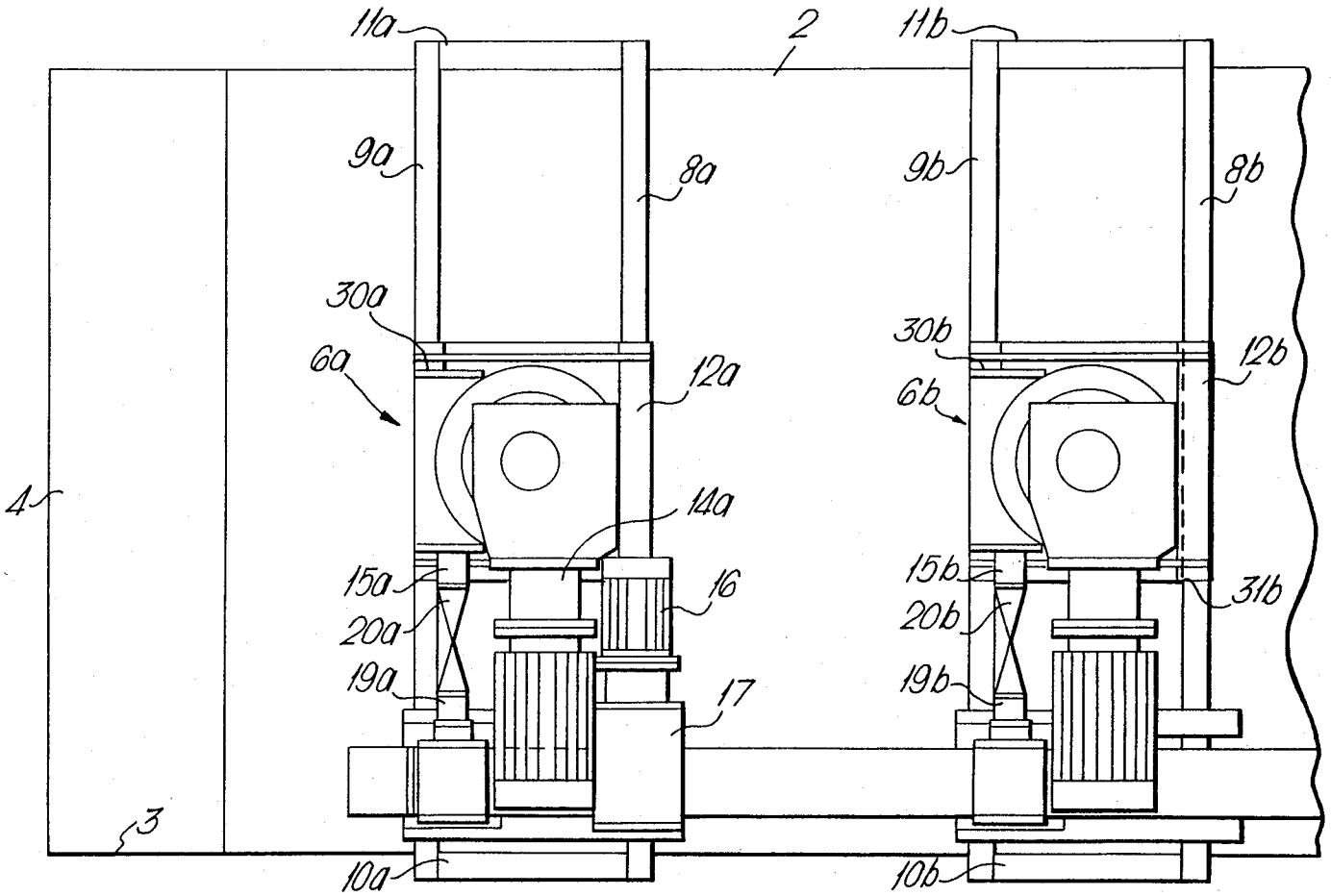

FIG. 3 is a plan view of FIG. 1.

According to the drawing the mixing device according to the invention comprises a mixing vessel, generally indicated with 1, and being open at the upper side. The mixing vessel has a elongated, preferentially rectangular plan view.

The mixing vessel is provided with vertical longitudinal side walls 2, 3 and oblique transverse side walls, of which only the wall 3 is visible. Furthermore the mixing vessel has a flat bottom wall 5.

Transversely to the longitudinal direction of the mixing vessel 1 a series of agitating devices, generally indicated with 6*a*, 6*b*, etc., has been mounted on top of the mixing vessel 1. In the drawing of the shown embodiment only the agitating devices 6*a*, 6*b* are visible, but it will be clear that this number need not be limited to two, but that this number is determined by the spacial conditions of the application of the mixing device.

The agitating devices 6*a*, 6*b*, etc. of the series lie with their axes 22*a*, 22*b*, etc. in a substantially vertical, flat plane.

The agitating devices 6*a*, 6*b* each rest on a frame 7*a*, 7*b* which is provided with two longitudinal beams 8*a*, 8*b* and 9*a*, 9*b*, which beams extend transversely to the longitudinal direction of the mixing vessel 1. These longitudinal beams 8*a*, 9*a* and 8*b*, 9*b* respectively are connected by transverse beams 10*a*, 11*a* and 10*b*, 11*b* respectively, which have been mounted near the outer ends of the longitudinal beams.

The agitating devices 6*a* and 6*b* respectively rest with their support flange 12*a* and 12*b* respectively on the upper side of the support frames 7*a* and 7*b* respectively and have been fastened thereto by means of (non shown) means, such as for instance screw bolts and nuts.

On the support flange 12*a* and 12*b* respectively rests the gear box 13*a* and 13*b* respectively, which are driven on the one hand by means of the main electric motors 14*a* and 14*b* respectively and the additional drive 15*a* and 15*b* respectively. For this additional drive only one drive motor 16 is necessary for the complete series of agitating devices 6*a*, 6*b*, etc., which motor is coupled through a gear box 17 with the drive shaft 18 extending in the longitudinal direction of the mixing vessel 1. The drive shaft 18 has at the location of the agitating devices a branch shaft 19*a* and 19*b* respectively, which is coupled by means of a detachable coupling 20*a* and 20*b* respectively with the input shaft 15*a* and 15*b* respectively of the additional drive.

Beneath the support frame 7*a* and 7*b* respectively the agitating device comprises the head 21*a* and 21*b* respectively which rotates around its substantially vertical axis 22*a* and 22*b* respectively. Out of the head 21*a* and 21*b* respectively at both sides project the short support arm 23*a* and 23*b* respectively and the long support arm 24*a* and 24*b* respectively which lie in extension with each other. At the end of the short support arm 23*a* and 23*b* respectively a bend 25*a* and 25*b* respectively is fastened, whereas at the end of the long support arm 24*a* and 24*b* respectively the bend 26*a* and 26*b* respectively is fastened.

Below the bend 25*a* and 25*b* respectively the mixing screw 27*a* and 27*b* respectively is fastened, whereas below the bend 26*a* and 26*b* respectively the mixing screw 28*a* and 28*b* respectively is fastened. These mixing screws are driven by (not shown) drive shafts extending through the bends, support arms and heads, preferably in such a way that the number of revolutions are the same. Mixing screw 27*a*, 27*b* fastened to short support arm 23*a*, 23*b* has a larger outside diameter than mixing screw 28*a*, 28*b*, mounted on long support arm 24*a* and 24*b*.

In the shown embodiment the axes of the rotatable mixing screws 27*a* and 28*b* respectively, 27*b* and 28*b* respectively, each make an acute angle $\alpha$ with the vertical, which angle is preferably about 10°.

The distances between the axes 22*a* and 22*b* of the agitating devices 6*a* and 6*b* respectively are smaller than the sum of the lengths of the largest arms 24*a* and 24*b*. This means, that the agitating devices agitate through each other and therefor have a mutual phase difference of preferably substantially 90°.

The support flanges 12*a*, 12*b* of the agitating devices 6*a*, 6*b* are provided with hoisting eyes 30*a* and 31*a* respectively, 30*a* and 31*b* respectively, which enable the installing and possibly replacement of the complete drive unit after detachment of the coupling 20*a* and 20*b* respectively, whereas the longitudinal beams 8*a*, 8*b* and 9*a*, 9*b* with the cross beams 10*a*, 11*a* and 10*b*, 11*b* can stay fastened to the mixing vessel 1.

According to a special embodiment of the invention of one or more agitating devices 6*a*, 6*b* the one mixing screw 27*a*, 27*b* has a contrary pitch than the other mixing screw 28*a*, 28*b*. In this way a push-pull effect of the mixing screws is obtained, whereby the mixing is further improved.

I claim:

1. A device for keeping drill cuttings in suspension in a viscous drilling mud comprising:

a mixing vessel (1) for containing the mud and cuttings;

a plurality of agitating devices (6) mounted on the vessel to project into the vessel, each of said agitating devices comprising:

a pair of generally horizontal support arms (23, 24) connected to a head (21), one of said support arms (24) being longer than the other of said support arms (23);

first drive means (13, 14) coupled to said head for rotating said arms about a generally vertical axis (22);

an elongated mixing screw (17, 18) mounted on the end of each of said arms and extending downwardly into said vessel, said mixing screws being of equal length, the mixing screw (27) mounted on the end of said shorter support arm (23) having a larger outside diameter than the mixing screw (28) mounted on said longer support arm (24); and second drive means (15) coupled to said mixing screws for rotating each of said screws about its own longitudinal axis.

2. A device according to claim 1, in which at least a part of the axes of the rotatable mixing screws each make an acute angle $\alpha$ with the vertical.

3. A device according to claim 2, in which the acute angle $\alpha$ of the axes of the rotatable mixing screws is about 10°.

4. A device according to claim 1 in which the plurality of agitating devices lie with their axes in a common substantially vertical plane.

5. A device according to claim 1 in which the horizontal distance between the axes of said plurality of agitating devices is smaller than the sum of the longer arm lengths thereof, said arms having a phase difference of substantially 90° in their rotation by means of which mutual contact is obviated.

6. A device according to claim 1 in which in one or more agitating devices one mixing screw has a contrary pitch to that of the other mixing screw.

7. A device according to claim 1 wherein said second drive means has a central shaft fastened above the mixing vessel, said shaft being driven by a single drive motor.

8. A device according to claim 1, in which the mixing vessel is an open tank having an elongated, preferably rectangular configuration in plan view.

* * * * *